US009666154B2

(12) United States Patent
Jung et al.

(10) Patent No.: US 9,666,154 B2
(45) Date of Patent: May 30, 2017

(54) LIQUID CRYSTAL DISPLAY AND METHOD OF DRIVING THE SAME

(71) Applicant: SAMSUNG DISPLAY CO., LTD., Yongin, Gyeonggi-Do (KR)

(72) Inventors: Jin-Soo Jung, Hwaseong-si (KR); Hwa Sung Woo, Asan-si (KR); Jun Woo Lee, Seongnam-si (KR); Baek Kyun Jeon, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 194 days.

(21) Appl. No.: 14/485,231

(22) Filed: Sep. 12, 2014

(65) Prior Publication Data

US 2015/0243229 A1 Aug. 27, 2015

(30) Foreign Application Priority Data

Feb. 27, 2014 (KR) ..... 10-2014-0023446

(51) Int. Cl.
*G09G 3/36* (2006.01)

(52) U.S. Cl.
CPC ... *G09G 3/3688* (2013.01); *G09G 2320/0219* (2013.01)

(58) Field of Classification Search
CPC ..... G09G 3/3688; G09G 2320/0219
See application file for complete search history.

(56) References Cited

U.S. PATENT DOCUMENTS 4,877,718 A * 10/1989 Moore ..... G03F 7/039 430/270.1
6,063,829 A 5/2000 Endou et al.
6,437,716 B2 8/2002 Nakao
6,808,766 B1 * 10/2004 Miyama ..... C08G 69/32 428/1.2
7,218,303 B2 * 5/2007 Kim ..... G02F 1/141 345/97
7,417,612 B2 8/2008 Lee et al.
(Continued)

FOREIGN PATENT DOCUMENTS

JP 2002-250908 9/2002
JP 2003-066410 3/2003
(Continued)

*Primary Examiner* — Lun-Yi Lao
*Assistant Examiner* — Kelly Hegarty
(74) *Attorney, Agent, or Firm* — F. Chau & Associates, LLC

(57) ABSTRACT

A liquid crystal display includes: a signal controller configured to receive an input image signal corresponding to a gray from the outside, and an image signal corrector configured to correct the input image signal. The image signal corrector is configured to shift a first input image signal value corresponding to a black gray by a first value based on a common voltage, is configured to shift a second input image signal value corresponding to a halftone gray by a second value based on the common voltage, and is configured to shift a third input image signal value corresponding to a white gray by a third value based on the common voltage. The first value and the second value are larger than a kickback voltage of each of the black gray and the halftone gray, and the third value is the same as a kickback voltage of the white gray.

21 Claims, 9 Drawing Sheets

(56) References Cited

U.S. PATENT DOCUMENTS

| | | | | |
|---|---|---|---|---|
| 8,581,820 | B2 * | 11/2013 | Woo | G09G 3/3614 345/87 |
| 8,599,122 | B2 * | 12/2013 | Shin | G09G 3/3648 345/94 |
| 8,698,787 | B2 * | 4/2014 | Im | G09G 3/3688 345/209 |
| 9,153,186 | B2 * | 10/2015 | Al-Dahle | G09G 3/3648 |
| 2004/0169629 | A1 * | 9/2004 | Lee | G09G 3/2011 345/95 |
| 2006/0176260 | A1 | 8/2006 | Koyama | |
| 2008/0185589 | A1 * | 8/2008 | Shin | G02F 1/136213 257/59 |
| 2008/0198122 | A1 * | 8/2008 | Shin | G09G 3/3648 345/94 |
| 2008/0204645 | A1 * | 8/2008 | Kawabe | G02F 1/13394 349/123 |
| 2008/0272998 | A1 | 11/2008 | Yano et al. | |
| 2012/0098818 | A1 | 4/2012 | Yoon | |
| 2012/0169779 | A1 | 7/2012 | Lee | |
| 2012/0229523 | A1 | 9/2012 | Maruyama et al. | |
| 2012/0249940 | A1 * | 10/2012 | Choi | G02F 1/133753 349/123 |
| 2013/0293526 | A1 * | 11/2013 | Igawa | G09G 3/3696 345/212 |

FOREIGN PATENT DOCUMENTS

| | | |
|---|---|---|
| JP | 3893659 | 12/2006 |
| JP | 4504665 | 4/2010 |
| KR | 10-2007-0098365 | 10/2007 |
| KR | 10-2007-0117360 | 12/2007 |

* cited by examiner

LIQUID CRYSTAL DISPLAY AND METHOD OF DRIVING THE SAME

CROSS-REFERENCE TO RELATED APPLICATION

This application claims priority to Korean Patent Application No. 10-2014-0023446 filed on Feb. 27, 2014, the entire disclosure of which is hereby incorporated by reference herein in its entirety.

(a) Technical Field

The present disclosure relates to a liquid crystal display and a driving method of the liquid crystal display.

(b) Discussion of the Related Art

A liquid crystal display which is one of the most common types of flat panel displays currently in use, may include two sheets of display panels with field generating electrodes such as, for example, a pixel electrode and a common electrode, and a liquid crystal layer interposed therebetween.

The liquid crystal display generates an electric field in the liquid crystal layer by applying a voltage to the field generating electrodes, determines the direction of liquid crystal molecules of the liquid crystal layer by the generated electric field, and controls polarization of incident light, thereby displaying images.

The liquid crystal display includes a thin film transistor, and a gate line and a data line crossing each other are formed on a display panel of the liquid crystal display including the thin film transistor. In addition, a pixel corresponding to an area displaying a screen is connected to the thin film transistor.

When a gate-on voltage Von is applied to the gate line and then the thin film transistor is turned on, a data voltage Vd applied through the data line is charged in the pixel. An alignment state of the liquid crystal layer is determined according to an electric field formed between the pixel voltage Vp charged in the pixel and a common voltage Vcom applied in the common electrode. The data voltage Vd may be applied by varying a polarity for each frame.

The data voltage Vd applied to the pixel drops by a parasitic capacitance Cgs between the gate electrode and the source electrode to form the pixel voltage Vp. A voltage difference between the data voltage Vd and the pixel voltage Vp is called a kickback voltage Vkb.

A value of the kickback voltage Vkb varies according to a gray and a polarity to vary the pixel voltage Vp for each frame. As a result, a flicker defect due to the pixel difference is sensed, and the liquid crystal layer is influenced by a residual direct current (DC) voltage and thus there may be a difficulty in that an afterimage may be generated. To solve the afterimage and the like due to such a residual DC voltage, an asymmetrical gamma correction method and the like in which the data voltage is compensatively applied for each grayscale has been attempted, but separately from this, an alternating current (AC) afterimage may become a difficulty.

SUMMARY

Exemplary embodiments of the present invention provide a liquid crystal display and a driving method of the liquid crystal display having benefits of increasing visibility according to an AC afterimage.

An exemplary embodiment of the present invention provides a liquid crystal display which includes: a signal controller configured to receive an input image signal corresponding to a gray from the outside, an image signal corrector configured to correct the input image signal to generate a data input signal, and a data driver configured to supply a data voltage corresponding to the gray based on the data input signal, in which the gray includes a black gray, a white gray, and a halftone gray between the black gray and the white gray. The image signal corrector is configured to shift a first input image signal value corresponding to the black gray by a first value based on a common voltage, is configured to shift a second input image signal value corresponding to the halftone gray by a second value based on the common voltage, and is configured to shift a third input image signal value corresponding to the white gray by a third value based on the common voltage. The first value and the second value are larger than a kickback voltage of each of the black gray and the halftone gray, and the third value is the same as a kickback voltage of the white gray.

The kickback voltage of the black gray may be larger than the kickback voltage of the halftone gray, and the kickback voltage of the halftone gray may be larger than the kickback voltage of the white gray.

When a difference between the first value and the kickback voltage of the black gray is a first dummy value and a difference between the second value and the kickback voltage of the halftone gray is a second dummy value, the first dummy value and the second dummy value may be different from each other.

The common voltage may be determined by shifting a preliminary common voltage by the second value, and the preliminary common voltage may correspond to an offset value of the halftone gray.

The liquid crystal display may further include: a first substrate, a thin film transistor disposed on the first substrate, and a first electrode connected to the thin film transistor, in which when the data voltage is applied to the first electrode, offset values of the black gray and the halftone gray may be different from the common voltage, and an offset value of the white gray may be the same as the common voltage.

The liquid crystal display may further include: a first substrate, a thin film transistor disposed on the first substrate, a first electrode connected to the thin film transistor, and a first alignment layer disposed on the first electrode, in which the first alignment layer may include a copolymer of at least one of cyclobutanedianhydride (CBDA) and a cyclobutanedianhydride (CBDA) derivative, and a diamine.

The first alignment layer may be formed by polymerizing at least one of cyclobutanedianhydride (CBDA) represented by the following Chemical Formula (A) and a cyclobutanedianhydride (CBDA) derivative represented by the following Chemical Formula (B), and a diamine.

Chemical Formula (A)

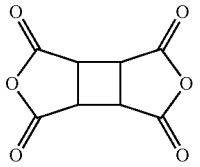

Chemical Formula (B)

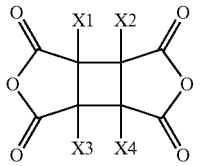

Herein, in Chemical Formula (B), each of X1, X2, X3, and X4 may be hydrogen or an organic compound, and at least one of X1, X2, X3, and X4 may not be hydrogen.

The liquid crystal display may further include a second electrode disposed on the first substrate, in which an insulating layer may be disposed between the first electrode and the second electrode. The first electrode may include a plurality of branch electrodes, and the second electrode may have a planar shape.

The plurality of branch electrodes may overlap with the second electrode having the planar shape.

The liquid crystal display may further include a passivation layer disposed between the thin film transistor and the second electrode, in which the thin film transistor and the first electrode may be connected to each other through a contact hole passing through the passivation layer and the insulating layer.

An exemplary embodiment of the present invention provides a driving method of a liquid crystal display including: receiving an input image signal from the outside, and correcting the input image signal to generate a data input signal, in which the correcting of the input image signal includes shifting a first input image signal value corresponding to a black gray by a first value based on a common voltage, shifting a second input image signal value corresponding to a halftone gray by a second value based on the common voltage, and shifting a third input image signal value corresponding to a white gray by a third value based on the common voltage. The first value and the second value are larger than a kickback voltage of each of the black gray and the halftone gray, and the third value is the same as a kickback voltage of the white gray.

The kickback voltage of the black gray may be larger than the kickback voltage of the halftone gray, and the kickback voltage of the halftone gray may be larger than the kickback voltage of the white gray.

When a difference between the first value and the kickback voltage of the black gray is a first dummy value and a difference between the second value and the kickback voltage of the halftone gray is a second dummy value, the first dummy value and the second dummy value may be different from each other.

The common voltage may be determined by shifting a preliminary common voltage by the second value, and the preliminary common voltage may correspond to an offset value of the halftone gray.

The liquid crystal display may include a first substrate, a thin film transistor disposed on the first substrate, and a first electrode connected to the thin film transistor, and when the data voltage is applied to the first electrode, offset values of the black gray and the halftone gray may be different from the common voltage, and an offset value of the white gray may be the same as the common voltage.

The liquid crystal display may include a first substrate, a thin film transistor disposed on the first substrate, a first electrode connected to the thin film transistor, and a first alignment layer disposed on the first electrode. The first alignment layer may include a copolymer of at least one of cyclobutanedianhydride (CBDA) and a cyclobutanedianhydride (CBDA) derivative, and a diamine.

The first alignment layer may be formed by polymerizing at least one of cyclobutanedianhydride (CBDA) represented by the following Chemical Formula (A) and a cyclobutanedianhydride (CBDA) derivative represented by the following Chemical Formula (B), and a diamine.

Chemical Formula (A)

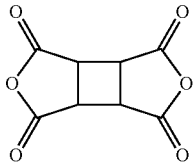

Chemical Formula (B)

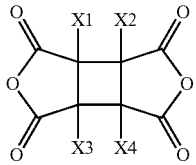

Herein, in Chemical Formula (B), each of X1, X2, X3, and X4 may be hydrogen or an organic compound, and at least one of X1, X2, X3, and X4 may not be hydrogen.

The liquid crystal display may further include a second electrode disposed on the first substrate, and an insulating layer may be disposed between the first electrode and the second electrode. The first electrode may include a plurality of branch electrodes, and the second electrode may have a planar shape.

The plurality of branch electrodes may overlap with the second electrode having the planar shape.

The liquid crystal display may further include a passivation layer disposed between the thin film transistor and the second electrode, and the thin film transistor and the first electrode may be connected to each other through a contact hole passing through the passivation layer and the insulating layer.

According to an exemplary embodiment, a liquid crystal display is provided. The liquid crystal display includes a plurality of gate lines extending substantially in a first direction and substantially parallel to each other, a plurality of data lines substantially parallel to each other and extending in a second direction substantially perpendicular to the first direction, a plurality of pixels including a switching element connected to the gate lines and data lines, a gray voltage generator configured to generate gray voltages related with transmittance of the pixels, a gate driver connected to the gate lines and configured to apply gate signals to the gate lines by combining a gate-on voltage and a gate-off voltage, and a signal controller including an image signal corrector.

The signal controller is configured to receive a plurality of input image signals corresponding to a gray from the outside and an input control signal controlling display of the input image signals, in which the gray includes a black gray, a white gray, and a halftone gray between the black gray and the white gray, in which the image signal corrector of the signal controller is configured to correct the input image signals to generate correction image signals, and in which the signal controller is configured to generate a gate control signal and a data control signal and to transmit the gate control signal to the gate driver and transmit the data control signal and the correction image signals to the data driver.

In addition, the image signal corrector is configured to correct the input image signals by shifting a first input image signal value corresponding to the black gray by a first value based on a common voltage, shifting a second input image signal value corresponding to the halftone gray by a second value based on the common voltage, and shifting a third input image signal value corresponding to the white gray by a third value based on the common voltage. The first value and the second value are larger than a kickback voltage of each of the black gray and the halftone gray, and the third value is the same as a kickback voltage of the white gray.

Also, the liquid crystal display further includes a data driver connected to the data lines and configured to receive the data control signal and the correction image signals from the signal controller and to select the gray voltages from the gray voltage generator corresponding to each of the correction image signals, and in which the data driver is configured to convert the correction image signals into data voltages and apply the data voltages to the corresponding data lines.

According to exemplary embodiment of the present invention, it is possible to prevent an AC afterimage in a white gray by image signal correction in which DC voltages having a black gray and a halftone gray are accumulated.

BRIEF DESCRIPTION OF THE DRAWINGS

Exemplary embodiments of the present invention can be understood in more detail from the following detailed description when taken in conjunction with the attached drawings in which.

DETAILED DESCRIPTION OF EXEMPLARY EMBODIMENTS

Figure 1:
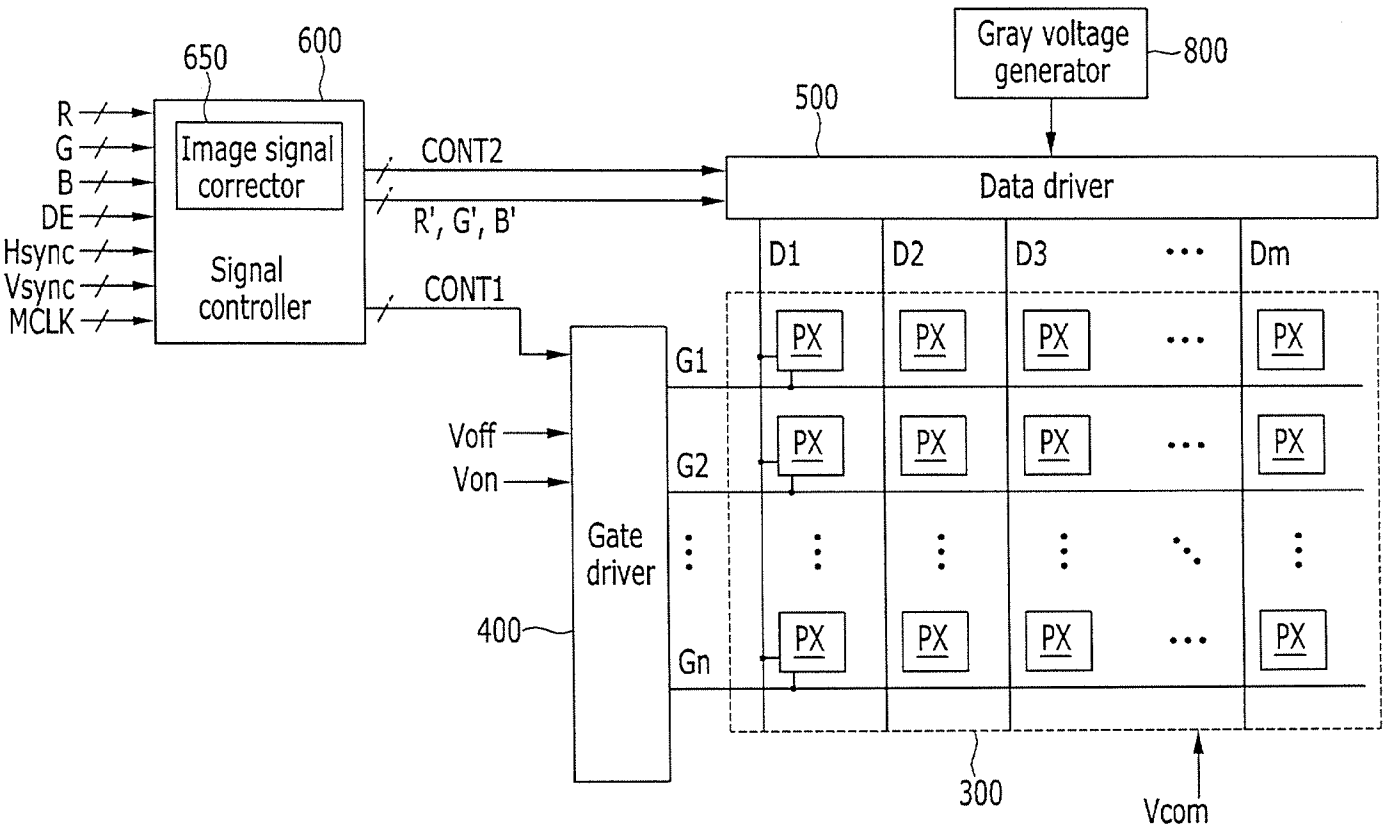
FIG. 1 is a block diagram of a liquid crystal display according to an exemplary embodiment of the present invention.

Hereinafter, exemplary embodiments of the present invention will be described in detail with reference to the accompanying drawings. As those skilled in the art would realize, the described embodiments may be modified in various different ways, all without departing from the spirit or scope of the present invention.

In the drawings, the thickness of layers, films, panels, regions, etc., may be exaggerated for clarity. It will be understood that when a layer is referred to as being "on" another layer or substrate, it can be directly on the other layer or substrate, or intervening elements may also be present. Like reference numerals designate like elements throughout the specification.

As used herein, the singular forms, "a", "an", and "the" are intended to include plural forms as well, unless the context clearly indicates otherwise.

Figure 2:
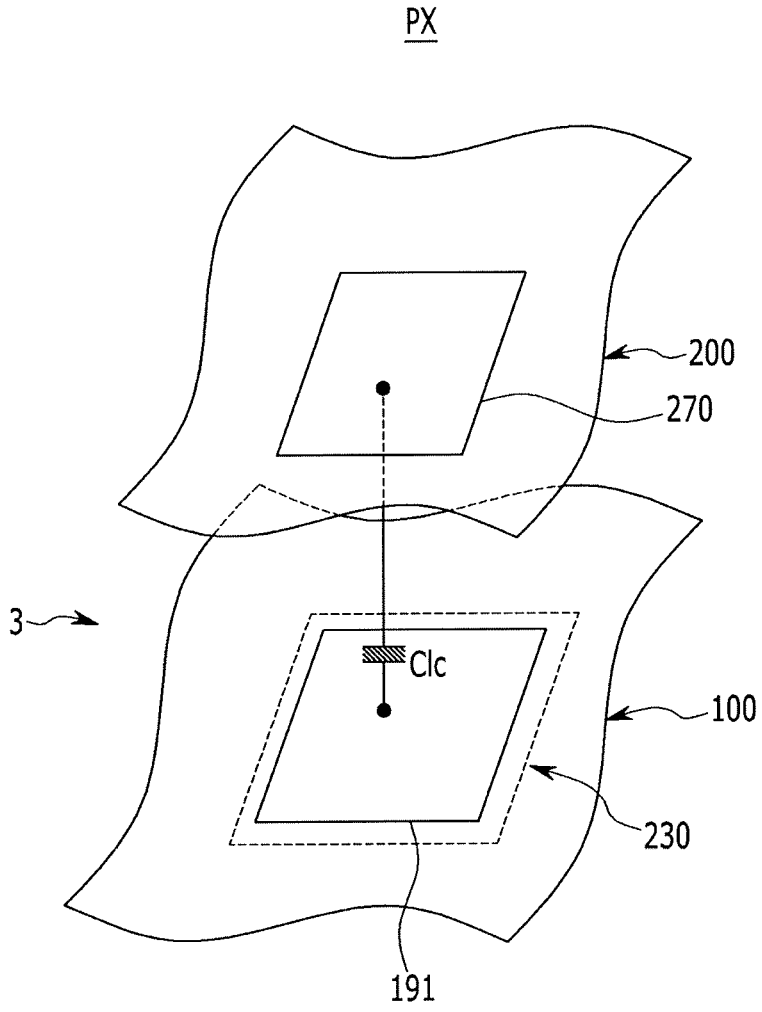
FIG. 2 is an equivalent circuit diagram of one pixel in the liquid crystal display according to an exemplary embodiment of the present invention.

FIG. 1 is a block diagram of a liquid crystal display according to an exemplary embodiment of the present invention, and FIG. 2 is an equivalent circuit diagram of one pixel in the liquid crystal display according to an exemplary embodiment of the present invention.

Referring to FIG. 1, a liquid crystal display according to the present exemplary embodiment of the present invention includes, for example, a liquid crystal panel assembly 300, a gate driver 400, a data driver 500, a gray voltage generator 800, and a signal controller 600. The signal controller 600 includes, for example, an image signal corrector 650.

Referring to FIG. 1, the liquid crystal panel assembly 300 includes, for example, a plurality of signal lines $G_1$-$G_n$ and $D_1$-$D_m$, and a plurality of pixels PX connected to the signal lines $G_1$-$G_n$ and $D_1$-$D_m$ and arranged substantially in a matrix form, when viewed from an equivalent circuit. On the other hand, when viewed as a structure illustrated in FIG. 2, the liquid crystal panel assembly 300 includes lower and upper panels 100 and 200 facing each other, and a liquid crystal layer 3 interposed therebetween.

The signal lines $G_1$-$G_n$ and $D_1$-$D_m$ include a plurality of gate lines $G_1$-$G_n$ transferring gate signals (referred to as "scanning signals"), and a plurality of data lines $D_1$-$D_m$ transferring data voltages. The gate lines $G_1$-$G_n$ extend, for example, substantially in a row direction and are substantially parallel to each other, and the data lines $D_1$-$D_n$ extend, for example, substantially in a column direction and are substantially parallel to each other, but exemplary embodiments of the present invention are not limited thereto. For example, alternatively, in an exemplary embodiment, the gate lines $G_1$-$G_n$ may extend, for example, substantially in the column direction and are substantially parallel to each other, and the data lines $D_1$-$D_m$ may extend, for example, substantially in the row direction and are substantially parallel to each other.

Each pixel PX, for example, a pixel PX connected to an i-th gate line $G_i$ (i=1, 2, . . . , n) and a j-th data line $D_j$ (j=1, 2, . . . , m) includes, for example, a switching element connected to the signal lines $G_i$ and $D_j$, and a liquid crystal capacitor Clc and a storage capacitor Cst connected thereto. The storage capacitor may be omitted if necessary.

The switching element is a three-terminal element such as a thin film transistor provided in the lower panel 100, and a control terminal thereof is connected to the gate line $G_i$, an input terminal is connected to the data line $D_j$, and an output terminal thereof is connected to the liquid crystal capacitor Clc and the storage capacitor Cst.

The liquid crystal capacitor Clc has a pixel electrode 191 of the lower panel 100 and a common electrode 270 of the upper panel 200 as two terminals, and the liquid crystal layer 3 between the pixel electrode 191 and the common electrode 270 serves as a dielectric material. The pixel electrode 191 is connected with the switching element, and the common electrode 270 is formed on the entire surface of the upper panel 200 to receive a common voltage Vcom. Unlike FIG. 2, alternatively, the common electrode 270 may, for example, be provided on the lower panel 100, and in this case, at least one of the pixel electrode 191 and the common electrode 270 may be formed in a linear shape or a rod shape.

The storage capacitor which plays a subordinate role of the liquid crystal capacitor Clc is formed by overlapping a separate signal line included in the lower panel 100 and the pixel electrode 191 with an insulator therebetween, and a predetermined voltage such as a common voltage Vcom is applied to the separate signal line. However, the storage capacitor may be formed by overlapping the pixel electrode 191 and a previous gate line $G_{i-1}$ immediately above through the insulator.

Meanwhile, to implement color display, each pixel PX uniquely displays one of primary colors (spatial division) or alternately displays the primary colors with time (temporal division) so that a desired color is recognized by the spatial and temporal sum of the primary colors. An example of the primary colors may include three primary colors such as red, green, and blue. FIG. 2 illustrates that each pixel PX includes a color filter 230 representing one of the primary colors in an area of the lower panel 100 corresponding to the pixel electrode 191, as an example of the spatial division. The color filter 230 may be made of, for example, an organic insulating layer.

At least one polarizer is provided in the liquid crystal panel assembly 300.

Then, the liquid crystal panel assembly 300 of the liquid crystal display according to an exemplary embodiment of the present invention will be described with reference to FIGS. 3 and 4. An exemplary embodiment described in FIGS. 3 and 4 is a case where the common electrode 270 is included in the lower panel 100, unlike FIG. 2.

Figure 3:
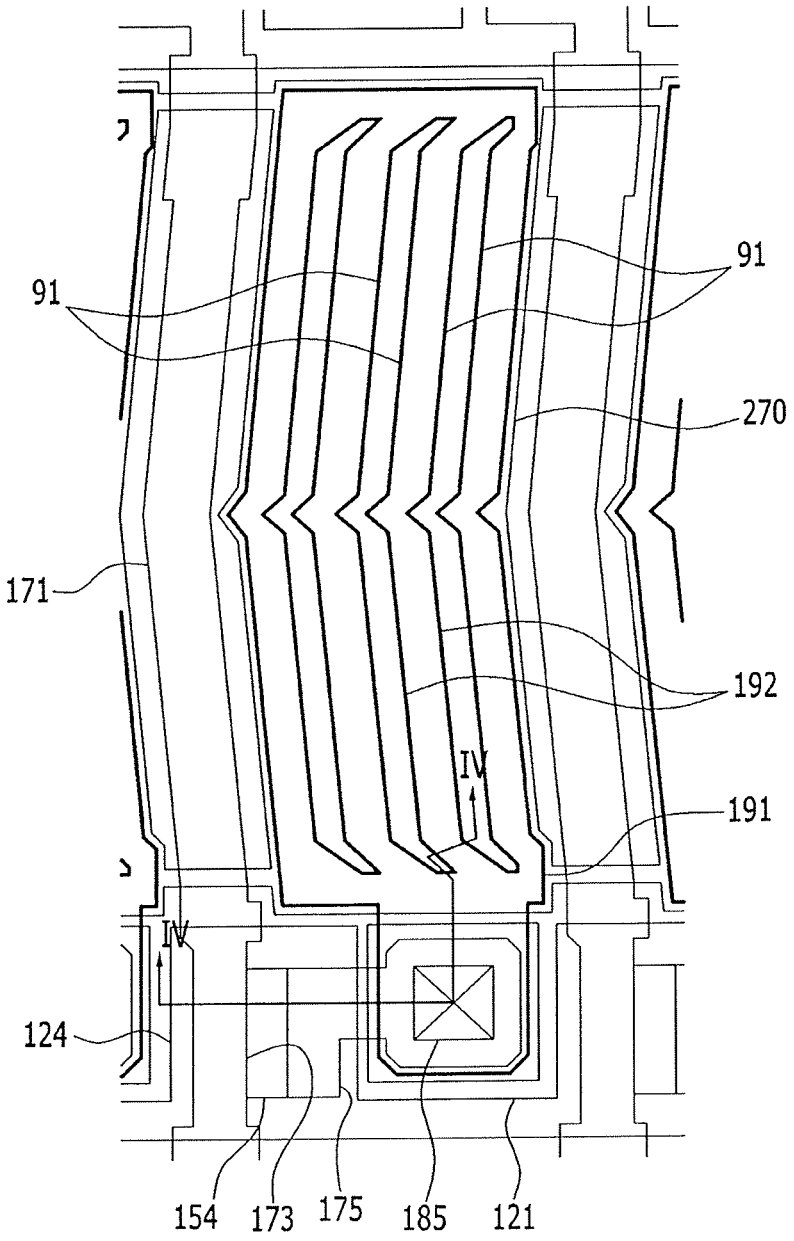
FIG. 3 is a plan view illustrating a liquid crystal display according to an exemplary embodiment of the present invention.

FIG. 3 is a plan view illustrating a liquid crystal display according to an exemplary embodiment of the present invention. FIG. 4 is a cross-sectional view of FIG. 3 taken along line IV-IV.

Figure 4:
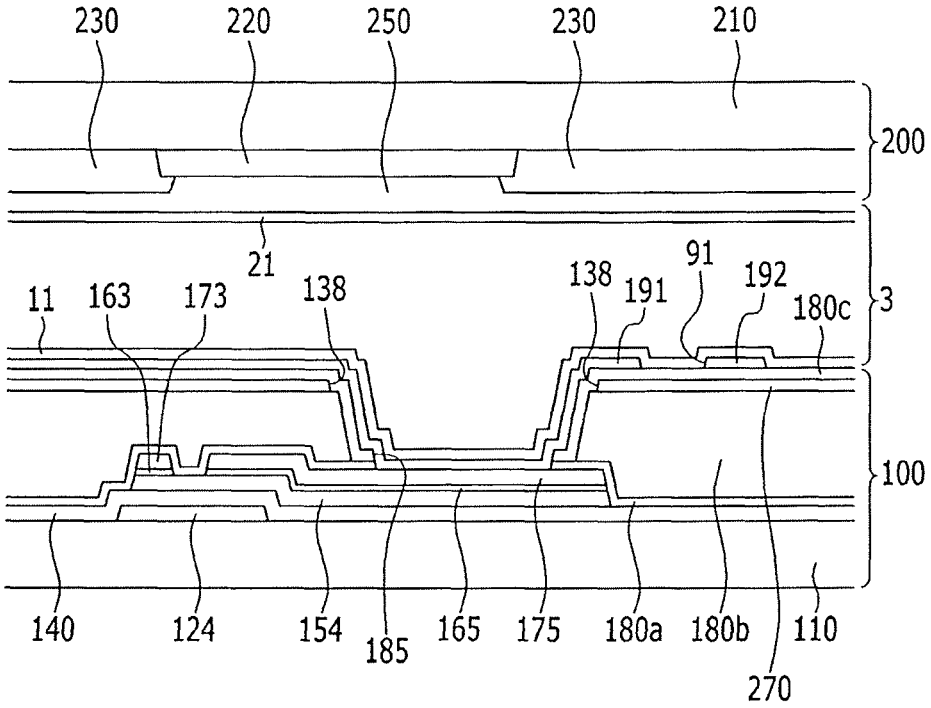
FIG. 4 is a cross-sectional view taken along line IV-IV of FIG. 3.

Referring to FIGS. 3 and 4, the liquid crystal display according to the present exemplary embodiment of the present invention includes a lower panel 100 and an upper panel 200 facing each other, and a liquid crystal layer 3 injected therebetween.

First, the lower panel 100 will be described.

A gate conductor including a gate line 121 is formed on a first substrate 110 made of, for example, transparent glass, quartz, plastic, or the like. Further, in an exemplary embodiment, the first substrate 110 may be, for example, a flexible substrate. Suitable materials for the flexible substrate include, for example, polyethersulfone (PES), polyethylenenaphthalate (PEN), polyethylene (PE), polyimide (PI), polyvinyl chloride (PVC), polyethylene terephthalate (PET), or combinations thereof.

The gate line 121 includes, for example, a gate electrode 124 and a wide end portion for connection with another layer or an external driving circuit. The gate line 121 may be made of, for example, an aluminum-based metal such as aluminum (Al) or an aluminum alloy, silver-based metal such as silver (Ag) or a silver alloy, copper-based metal such as copper (Cu) or a copper alloy, molybdenum-based metal such as molybdenum (Mo) or a molybdenum alloy, chromium (Cr), tantalum (Ta), and titanium (Ti). However, the gate line 121 may have, for example, a multilayer structure including at least two conductive layers having different physical properties.

A gate insulating layer 140 made of, for example, silicon nitride (SiNx), silicon oxide (SiOx), silicon oxynitride (SiOxNy), aluminum oxide (AlOx), yttrium oxide ($Y_2O_3$), hafnium oxide (HfOx), zirconium oxide (ZrOx), aluminum nitride (AN), aluminum oxynitride (AlNO), titanium oxide (TiOx), barium titanate (BaTiO3), lead titanate ($PbTiO_3$), or the like is formed on the gate line 121. The gate insulating layer 140 may have, for example, a multilayer structure including at least two insulating layers having different physical properties.

A semiconductor layer 154 made of, for example, amorphous silicon or polysilicon is disposed on the gate insulating layer 140. The semiconductor layer 154 may include, for example, an oxide semiconductor.

Ohmic contacts 163 and 165 are formed on the semiconductor layer 154. The ohmic contacts 163 and 165 may be made of, for example, a material such as n+ hydrogenated amorphous silicon in which an n-type impurity such as phosphorus is doped at high concentration, or silicide. The ohmic contacts 163 and 165 may be disposed on the semiconductor layer 154 to make a pair. In the case where semiconductor layer 154 includes an oxide semiconductor, the ohmic contacts 163 and 165 may be omitted.

A data conductor including a data line 171 including a source electrode 173 and a drain electrode 175 is formed on the ohmic contacts 163 and 165 and the gate insulating layer 140.

The data line 171 includes, for example, a wide end portion for connection with another layer or an external driving circuit. The data line 171 transfers a data signal and mainly extend in a vertical direction to cross the gate line 121.

In this case, the data line 171 may have, for example, a first curved portion having a curved shape to acquire maximum transmittance of the liquid crystal display, and the curved portion meets each other in a middle region of the pixel area to have a V-lettered shape. A second curved portion which is curved to form a predetermined angle with the first curved portion may be further included in the middle region of the pixel area.

The source electrode 173 is, for example, a part of the data line 171, and disposed on the same line as the data line 171. The drain electrode 175 is formed to, for example, extend in parallel with the source electrode 173. Accordingly, the drain electrode 175 is parallel with the part of the data line 171.

The gate electrode 124, the source electrode 173, and the drain electrode 175 form one thin film transistor (TFT) together with the semiconductor layer 154, and a channel of the thin film transistor (TFT) is formed in the semiconductor layer 154 portion between the source electrode 173 and the drain electrode 175.

The liquid crystal display according to the present exemplary embodiment of the present invention includes the source electrode 173 disposed on the same line with the data line 171 and the drain electrode 175 extending in parallel with the data line 171, and as a result, a width of the thin film transistor may be increased while an area occupied by the data conductor is not increased, thereby increasing an aperture ratio of the liquid crystal display.

For example, the data line 171 and the drain electrode 175 may be made of a refractory metal such as molybdenum, chromium, tantalum, and titanium or an alloy thereof, and may have a multilayered structure including a refractory metal layer and a low resistive conductive layer. An example of the multilayered structure may include a double layer of a chromium or molybdenum (alloy) lower layer and an aluminum (alloy) upper layer, or a triple layer of a molybdenum (alloy) lower layer, an aluminum (alloy) middle layer, and a molybdenum (alloy) upper layer.

A first passivation layer **180*a* is disposed on the data conductor 171, 173, and 175, the gate insulating layer 140, and an exposed portion of the semiconductor layer 154. The first passivation layer 180*a* may be made of, for example, an organic insulating material or an inorganic insulating material. For example, the organic insulating material of the first passivation layer 180***a* may include benzocyclobutene (BCB), an acryl-based resin or a combination thereof.

A second passivation layer 180*b* is formed on the first passivation layer 180*a*. The second passivation layer 180*b* may be made of, for example, an organic insulating material. For example, the organic insulating material of the second passivation layer 180*b* may include benzocyclobutene (BCB), an acryl-based resin or a combination thereof.

The second passivation layer 180*b* may be, for example, a color filter. In the case where the second passivation layer 180*b* is the color filter, the second passivation layer 180*b* may uniquely display one of the primary colors, and an example of the primary colors may include three primary colors such as red, green, and blue, or yellow, cyan, magenta, and the like. In addition, the color filter may further include a color filter displaying, for example, a mixed color of the primary colors or white other than the primary colors. In the case where the second passivation layer 180*b* is the color filter, the color filter 230 may be omitted in the upper panel 200 to be described below.

The common electrode 270 is formed on the second passivation layer 180*b*. The common electrode 270 has, for example, a planar shape and may be formed on the entire surface of the substrate 110 as a whole plate, and has an opening 138 disposed in a region corresponding to a periphery of the drain electrode 175. That is, the common electrode 270 may have the planar shape as the plate shape. The common electrode 270 may be made of, for example, a transparent conductive material such as indium tin oxide (ITO), indium zinc oxide (IZO), aluminum zinc oxide (AZO), cadmium tin oxide (CTO) or a combination thereof.

The common electrodes 270 disposed at the adjacent pixels are connected to each other to receive a common voltage having a predetermined magnitude supplied from the outside of a display area.

An insulating layer 180*c* is disposed on the common electrode 270. The insulating layer 180*c* may be made of, for example, an organic insulating material, an inorganic insulating material, or the like.

The pixel electrode 191 is disposed on the insulating layer 180*c*. The pixel electrode 191 includes, for example, a curved edge which is substantially parallel with the curved portion of the data line 171. The pixel electrode 191 has, for example, a plurality of cutouts 91, and includes, for example, a plurality of branch electrodes 192 disposed between the adjacent cutouts 91. The pixel electrode 191 may be made of, for example, a transparent conductive material such as indium tin oxide (ITO), indium zinc oxide (IZO), aluminum zinc oxide (AZO), cadmium tin oxide (CTO) or a combination thereof.

The pixel electrode 191 is a first field generating electrode or a first electrode, and the common electrode 270 is a second field generating electrode or a second electrode. A horizontal electric field may be generated between the pixel electrode 191 and the common electrode 270.

A first contact hole 185 exposing the drain electrode 175 is formed in the first passivation layer 180*a*, the second passivation layer 180*b*, and the insulating layer 180*c*. The pixel electrode 191 is physically and electrically connected to the drain electrode 175 through the contact hole 185 to receive a voltage from the drain electrode 175.

A first alignment layer 11 is formed on the pixel electrode 191 and the insulating layer 180*c*. The first alignment layer 11 includes, for example, a photoreactive material.

The first alignment layer 11 of the present exemplary embodiment includes, for example, a copolymer of at least one of cyclobutanedianhydride (CBDA) and a cyclobutanedianhydride (CBDA) derivative and a diamine. As such, a liquid crystal photo-alignment agent formed by, for example, polymerizing at least one of the cyclobutanedianhydride (CBDA) and the cyclobutanedianhydride (CBDA) derivative and the diamine may be formed by, for example, polymerizing at least one of cyclobutanedianhydride (CBDA) represented by, for example, the following Chemical Formula (A) and a cyclobutanedianhydride (CBDA) derivative represented by the following Chemical Formula (B), and a diamine.

Chemical Formula (A)

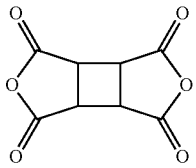

Chemical Formula (B)

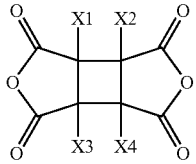

Herein, in Chemical Formula (B), each of X1, X2, X3, and X4 is hydrogen or an organic compound, and at least one of X1, X2, X3, and X4 is not hydrogen. The organic compound may include an alkyl group or alkoxyl group with a carbon number of 1 to 6. However, the organic compound is not particularly limited thereto.

In the present exemplary embodiment, the diamine may be aromatic diamine, such as, for example, p-phenylenediamine, m-phenylenediamine, 2,5-diaminotoluene, 2,6-diaminotoluene, 4,4'-diamino biphenyl, 3,3'-dimethyl-4,4'-diaminobiphenyl, 3,3'-dimethoxy-4,4'-diaminobiphenyl, diaminodiphenylmethane, diaminodiphenyl ether, 2,2'-diaminodiphenyl propane, bis(3,5-diethyl-4-aminophenyl) methane, diaminodiphenylsulfone, diaminobenzophenone, diaminonaphthalene, 1,4-bis(4-aminophenoxy)benzene, 1,4-bis(4-aminophenyl)benzene, 9,10-bis(4-aminophenyl) anthracene, 1,3-bis(4-aminophenoxy)benzene, 4,4'-bis(4-aminophenoxy)diphenyl sulfone, 2,2-bis[4-(4-aminophenoxyl)phenyl]propane, 2,2-bis(4-aminophenyl) hexafluoropropane, 2,2-bis[4-(4-aminophenoxyl)phenyl]hexa fluoropropane, alicyclic diamine, such as bis(4-aminocyclohexyl) methane, bis(4-amino-3-methylcyclohexyl) methane, aliphatic diamine, such as tetramethylene diamine and hexamethylene diamine, and the like, but exemplary embodiments of the present invention are not particularly limited thereto.

In the present exemplary embodiment, the copolymer included in the first alignment layer 11 may include, for example, repeated units represented by the following Chemical Formula (C), Chemical Formula (D), or Chemical Formula (E).

Chemical Formula (C)

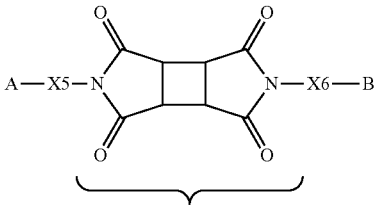

-continued

Chemical Formula (D)

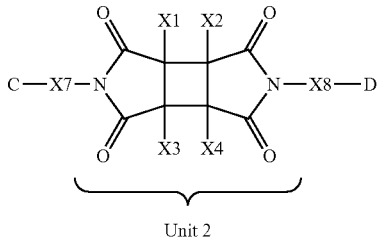

Chemical Formula (E)

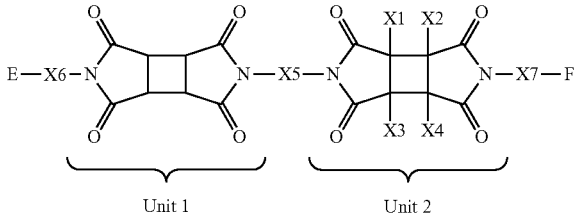

In Chemical Formula (C), Chemical Formula (D), and Chemical Formula (E), each of X5, X6, X7, and X8 is independently a body portion which is coupled with two amino groups (—NH2) of diamine, and each of A, B, C, D, E, and F is independently a unit 1 or a unit 2, and in Chemical Formula (D) and Chemical Formula (E), each of X1, X2, X3, and X4 is independently hydrogen, fluorine, or an organic compound, and at least one of X1, X2, X3, and X4 may not be hydrogen. The organic compound may include an alkyl group or alkoxyl group with a carbon number of 1 to 6. However, the organic compound is not particularly limited thereto.

Herein, a method of forming the alignment layer will be described.

For example, on the pixel electrode 191, a photo-alignment agent formed by polymerizing at least one of cyclobutanedianhydride (CBDA) and a cyclobutanedianhydride (CBDA) derivative and a diamine is coated. Thereafter, the coated photo-alignment agent is baked. The baking may be performed by, for example, two steps of pre-baking and hard-baking.

Thereafter, the first alignment layer 11 may be formed by, for example, irradiating polarized light to the photo-alignment agent. In this case, the irradiated light may use, for example, ultraviolet light having a range of about 240 nanometers to about 380 nanometers. For example, the ultraviolet light of 254 nanometers may be used. To increase an alignment property, the first alignment layer 11 may be baked once more.

Next, the upper panel 200 will be described.

A light blocking member 220 is formed on a second substrate 210 made of, for example, transparent glass, quartz, or plastic. Further, in an exemplary embodiment, the second substrate 210 may be, for example, a flexible substrate. Suitable materials for the flexible substrate include, for example, polyethersulfone (PES), polyethylenenaphthalate (PEN), polyethylene (PE), polyimide (PI), polyvinyl chloride (PVC), polyethylene terephthalate (PET), or combinations thereof.

The light blocking member 220 is called a black matrix and blocks light leakage.

A plurality of color filters 230 is formed on the second substrate 210. In the case where the second passivation layer 180*b* of the lower panel 100 is a color filter, the color filter 230 of the upper panel 200 may be omitted. Further, the light blocking member 220 of the upper panel 200 may also be formed on the lower panel 100.

An overcoat 250 is formed on the color filter 230 and the light blocking member 220. The overcoat 250 may be made of, for example, an (organic) insulating material, prevents the color filter 230 from being exposed, and provides a flat surface. Alternatively, in an exemplary embodiment, the overcoat 250 may be omitted.

A second alignment layer 21 is formed on the overcoat 250. The second alignment layer 21 includes, for example, a photoreactive material. The second alignment layer 21 may be, for example, formed of the same material and by the same method as the first alignment layer 11 described above.

The liquid crystal layer 3 may include a liquid crystal material having, for example, positive dielectric anisotropy.

The liquid crystal molecules of the liquid crystal layer 3 are aligned so that long axes thereof are parallel to the lower and upper panels 100 and 200.

The pixel electrode 191 receives a data voltage from the drain electrode 175, and the common electrode 270 receives a common voltage having a predetermined magnitude from a common voltage applying unit disposed outside of the display area.

The pixel electrode 191 and the common electrode 270 which are field generating electrodes generate an electric field and thus the liquid crystal molecules of the liquid crystal layer 3 disposed on the two field generating electrodes 191 and 270 rotate in a parallel direction to the direction of the electric field. Polarization of light passing through the liquid crystal layer 3 varies according to the rotation directions of the liquid crystal molecules determined as described above.

As such, the two field generating electrodes (pixel electrode 191 and common electrode 270) are formed on one display panel, e.g. the lower display panel 100, thereby increasing transmittance of the liquid crystal display and implementing a wide viewing angle.

According to the liquid crystal display according to the present exemplary embodiment, the common electrode 270 has the planar shape, and the pixel electrode 191 has the plurality of branch electrodes 192, but exemplary embodiments of the present invention are not limited thereto. Alternatively, with a liquid crystal display according to an exemplary embodiment of the present invention, the pixel electrode 191 may have, for example, the planar shape, and the common electrode 270 may have, for example, the plurality of branch electrodes.

Exemplary embodiments of the present invention may be applied to all other cases where the two field generating electrodes are overlapped with each other on the first substrate 110 with an insulating layer therebetween, such as, for example, when the first field generating electrode is formed below the insulating layer and has a planar shape, and the second field generating electrode is formed on the insulating layers and a plurality of branch electrodes.

Next, a driving device of a liquid crystal display according to an exemplary embodiment of the present invention will be described in more detail.

Referring back to FIG. 1, the gray voltage generator 800 generates all gray voltages related with transmittance of the pixel PX or a predetermined number of gray voltages. The gray voltages may include a gray voltage having a positive value and a gray voltage having a negative value with respect to a common voltage Vcom.

The gate driver 400 is connected to the gate lines $G_1$-$G_n$ of the liquid crystal panel assembly 300 to apply gate signals configured by combining a gate-on voltage Von and a gate-off voltage Voff to the gate lines $G_1$-$G_n$.

The data driver 500 is connected to the data lines $D_1$-$D_m$ of the liquid crystal panel assembly 300, and selects gray voltages from the gray voltage generator 800, and applies the selected gray voltages to the data lines $D_1$-$D_m$ as data voltages. However, in the case where the gray voltage generator 800 does not provide all the gray voltages, but provides only the predetermined number of gray voltages, the data driver 500 generates a desired data voltage by dividing the gray voltages.

The signal controller 600 controls the gate driver 400 and the data driver 500. The signal controller 600 includes, for example, an image signal corrector 650.

Each of the gate driver 400, the data driver 500, the signal controller 600, and the gray voltage generator 800 may be, for example, directly mounted on the liquid crystal panel assembly 300 in at least one IC chip form, mounted on a flexible printed circuit film to be attached to the liquid crystal panel assembly 300 in a tape carrier package (TCP) form, or mounted on a separate printed circuit board. Alternatively, the gate driver 400, the data driver 500, the signal controller 600, and the gray voltage generator 800 may be, for example, integrated on the liquid crystal panel assembly 300 together with the signal lines $G_1$-$G_n$ and $D_1$-$D_m$, a thin film transistor switching element, and the like. Further, the gate driver 400, the data driver 500, the signal controller 600, and the gray voltage generator 800 may be, for example, integrated by a single chip, and in this case, at least one of the gate driver 400, the data driver 500, the signal controller 600 and the gray voltage generator 800 or at least one circuit element configuring the gate driver 400, the data driver 500, the signal controller 600 and the gray scale generator 800 may be disposed outside of the single chip.

Next, an operation of the liquid crystal display will be described in detail.

The signal controller 600 receives input image signals R, G, and B and an input control signal controlling display of the input image signals R, G, and B from an external graphic controller. The input image signals R, G and B store luminance information of each pixel PX, and the luminance has a predetermined number of grays such as, for example, 1024 ($=2^{10}$), 256 ($=2^8$), or 64 ($=2^6$) grays. An example of the input control signal includes a vertical synchronization signal (Vsync), a horizontal synchronization signal (Hsync), a main clock signal (MCLK), a data enable signal (DE), or the like.

The signal controller 600 properly processes the input image signals R, G and B in accordance with an operational condition of the liquid crystal panel assembly 300 based on the input control signal, and generates a gate control signal CONT1, a data control signal CONT2, and the like, and then transmits the gate control signal CONT1 to the gate driver 400 and transmits the data control signal CONT2 and correction image signals R', G', and B' to the data driver 500. For example, the image signal corrector 650 of the signal controller 600 properly corrects the input image signals R, G, and B so as to prevent an afterimage of the liquid crystal panel assembly 300, which will be described below in detail.

The gate control signal CONT1 includes, for example, a scanning start signal STV instructing scanning start, and at least one clock signal controlling an output period of the gate-on voltage Von. The gate control signal CONT1 may further include, for example, an output enable signal limiting a duration time of the gate-on voltage Von.

The data control signal CONT2 includes, for example, a horizontal synchronization start signal STH notifying transmission start of a digital image signal for pixels PX in one row, a load signal instructing an analog data voltage to be applied to the data lines $D_1$-$D_m$, and a data clock signal. The data control signal CONT2 may further include, for example, a reversion signal reversing a polarity of the data voltage (hereinafter, referred to as a "polarity of the data voltage" by shortening a "polarity of the data voltage for the common voltage") for the common voltage Vcom.

According to the data control signal CONT2 from the signal controller 600, the data driver 500 receives the correction image signals R', G', and B' for pixels PX in one row and selects a gray voltage corresponding to each of the correction image signals R', G', and B' to convert the correction image signals R', G', and B' into analog data voltages and then apply the converted analog data voltages to the corresponding data lines $D_1$-$D_m$.

The gate driver 400 applies the gate-on voltage Von to the gate lines $G_1$-$G_n$ according to the gate control signal CONT1 from the signal controller 600 to turn on the switching elements connected to the gate lines $G_1$-$G_n$. Then, the data voltages applied to the data lines $D_1$-$D_m$ are applied to the corresponding pixels PX through the turned-on switching elements.

A difference between the data voltage applied to the pixel PX and the common voltage Vcom is represented as a charging voltage of a liquid crystal capacitor Clc, that is, a pixel voltage. The arrangement of the liquid crystal molecules varies according to a magnitude of the pixel voltage, and as a result, polarization of light passing through the liquid crystal layer 3 is changed. The change in the polarization is represented as a change in transmittance of light by a polarizer, and as a result, the pixel PX displays luminance expressed by a gray of the image signal.

The process is repeated by setting 1 horizontal period [referred to as "1H", and being the same as one period of a horizontal synchronization signal Hsync and a data enable signal DE] by a unit, and as a result, the gate-on voltages Von are sequentially applied to all the gate lines $G_1$-$G_n$, and the data voltages are applied to all the pixels PX, thereby displaying images for one frame.

When one frame ends, the next frame starts, and a state of the reversion signal applied to the data driver 500 is controlled so that the polarity of the data voltage applied to each pixel PX is opposite to a polarity in the previous frame ("frame inversion"). In this case, according to a characteristic of the reversion signal even in one frame, a polarity of the data voltage flowing through one data line may be periodically changed (for example, row inversion and dot inversion), or polarities of the data voltages applied to one pixel row may be different from each other (for example, column inversion and dot inversion).

Next, image signal correction of the image signal corrector 650 of the signal controller 600 of the liquid crystal display according to the present exemplary embodiment of the present invention will be described.

First, a kickback voltage Vkb which is changed according to the polarity of the gray voltage will be described.

The kickback voltage Vkb is represented, for example, as follows.

$$Vkb = \frac{Cgs}{(Clc + Cst + Cgs)}(Vg) \quad \text{[Equation 1]}$$

Herein, Cgs represents a parasitic capacitance between a gate electrode and a source electrode, Clc represents a liquid crystal capacitance, Cst represents a storage capacitance, and Vg represents a gate voltage.

Further, the liquid crystal capacitance Clc is represented, for example, as follows.

$$Clc = \varepsilon 0 \cdot \varepsilon \cdot \frac{A}{d} \quad \text{[Equation 2]}$$

Herein, ∈0 represents a dielectric constant of the liquid crystal in a vacuum, ∈ represents a dielectric constant of the liquid crystal, d represents a cell gap, and A represents an overlapped area between a pixel electrode layer and a common electrode layer.

A value of the liquid crystal capacitance Clc is changed according to an alignment state of the liquid crystal. This is caused by dielectric anisotropy of the liquid crystal, and for example, in a normally black mode, a liquid crystal dielectric constant in a black state (horizontal dielectric constant, ∈) is smaller than a liquid crystal dielectric constant in a white state (vertical dielectric constant, ∈). Accordingly, the liquid crystal capacitance Clc in the white state is larger than the liquid crystal capacitance Clc in the black state, and the kickback voltage Vkb in the white state is smaller than the kickback voltage Vkb in the black state.

The liquid crystal capacitance Clc in the black state influenced by the horizontal dielectric constant ∈ is smaller than the liquid crystal capacitance Clc in the white state influenced by the vertical dielectric constant ∈, and the kickback voltage Vkb in the black state is larger than the kickback voltage Vkb in the white state.

The kickback voltage Vkb varies according to a gray, and as a result, an optimal common voltage Vcom defined as an arithmetic mean value of a positive pixel voltage Vp(+) and a negative pixel voltage Vp(−) varies according to a gray. Meanwhile, an actual common voltage Vcom may be calculated through an experiment in a halftone gray. Due to a difference between the optimal common voltage Vcom generated by the kickback voltage Vkb and the actual common voltage Vcom, the pixel voltages Vp are different from each other during applying of the positive data voltage Vp(+) and during applying of the negative data voltage Vp(−), and as a result, a flicker and an afterimage are generated.

Accordingly, to compensate the optimal common voltage Vcom value for each gray which is changed by the kickback voltage Vkb, the data voltage Vd value for each gray may be compensatively applied in advance by considering the kickback voltage Vkb value. Hereinafter, a method of compensating and applying the data voltage value for each gray by considering the kickback voltage value will be described with reference to FIGS. 5(*a*)-(*b*).

Figure 5:
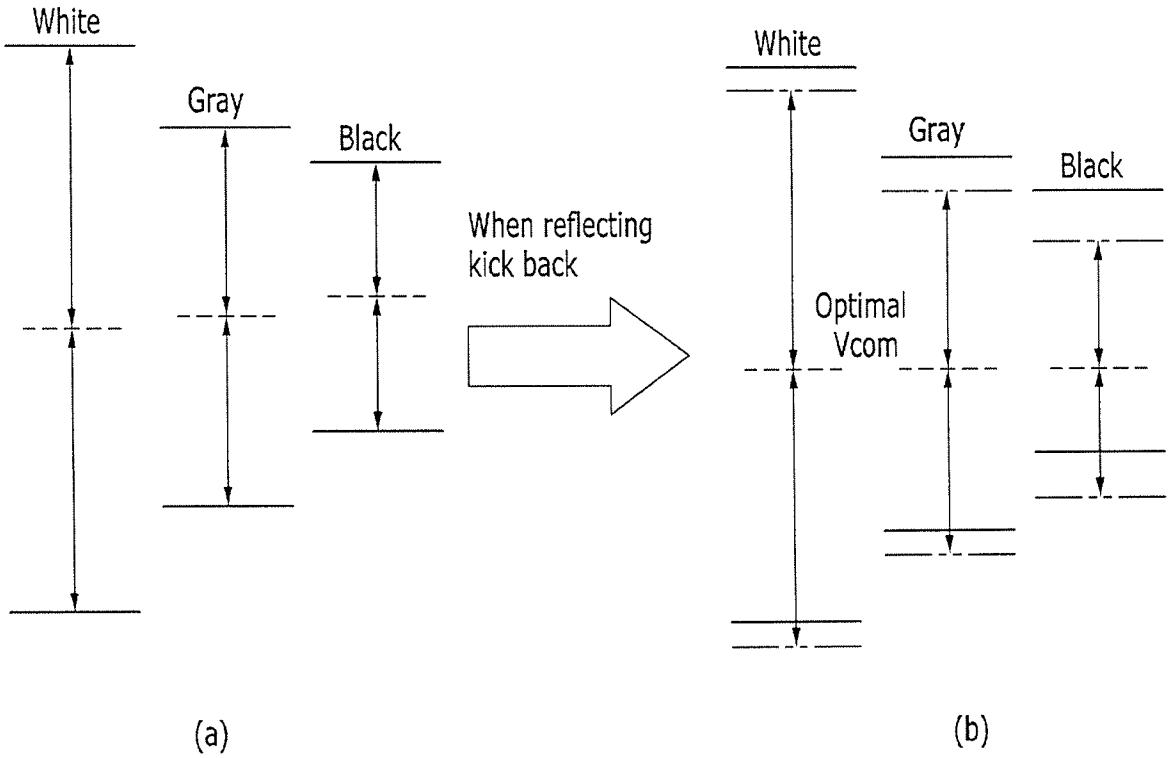
FIGS. 5(*a*)-(*b*) illustrate a process of optimizing a voltage applied to a pixel by asymmetrical gamma correction.

FIGS. 5(*a*)-5(*b*) illustrate a process of optimizing a voltage applied to a pixel by asymmetrical gamma correction.

By a change in liquid crystal capacitance Clc according to a gray, in a normally black mode, the kickback voltage Vkb is large in a black gray and small in a white gray. Accordingly, like FIG. 5(*a*), the data voltage for each gray is compensatively applied in advance in accordance with the kickback voltage Vkb, and as a result, actually, the voltage applied to the pixel to which the kickback voltage Vkb is reflected is represented as illustrated in FIG. 5(*b*). Therefore, the optimal common voltage Vcom for each gray may be equalized. Herein, an offset value compensatively applied for each gray has a small value from the black gray to the white gray. In an exemplary embodiment, a difference between a sum of the positive voltage and the negative voltage and the common voltage may be referred to as the offset value.

Even though the data voltage for each gray is compensatively applied by the asymmetrical gamma correction method described in FIGS. 5(*a*)-(*b*), a DC afterimage may be prevented, but an AC afterimage may still become a difficulty.

Figure 6:
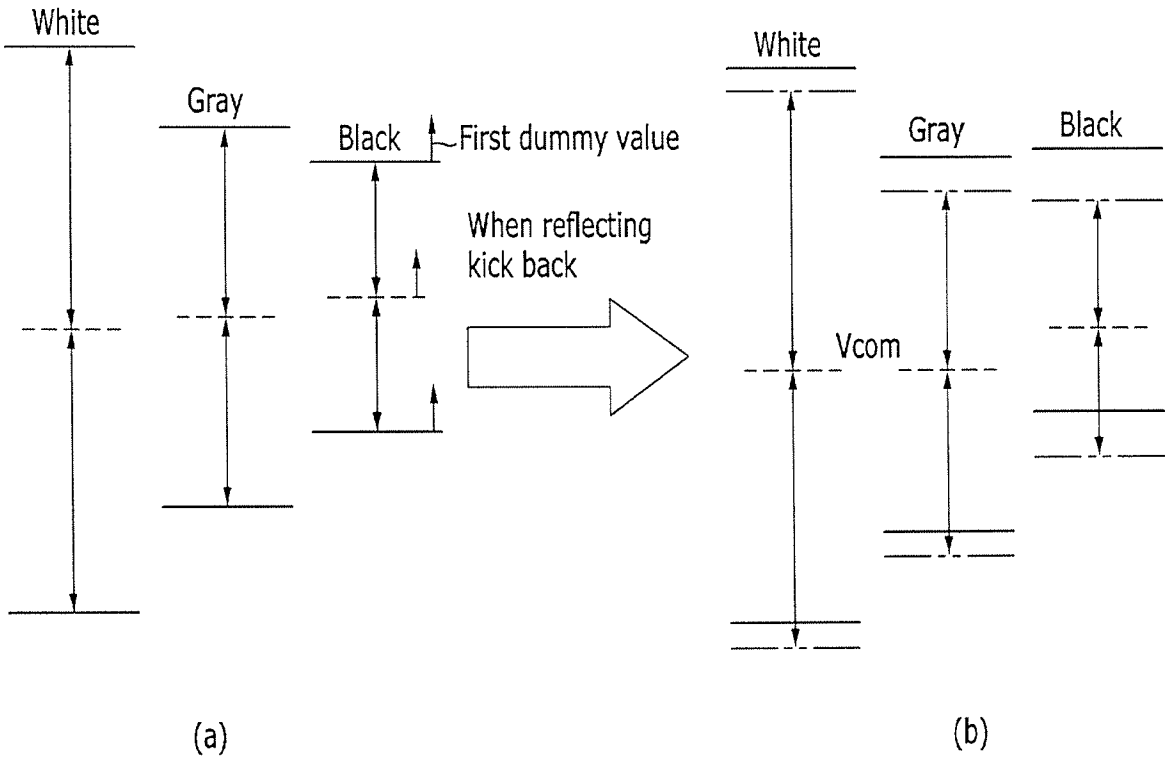
FIGS. 6(*a*)-(*b*) illustrate a process of optimizing a voltage applied to a pixel by asymmetrical gamma correction according to an exemplary embodiment of the present invention.
Figure 7:
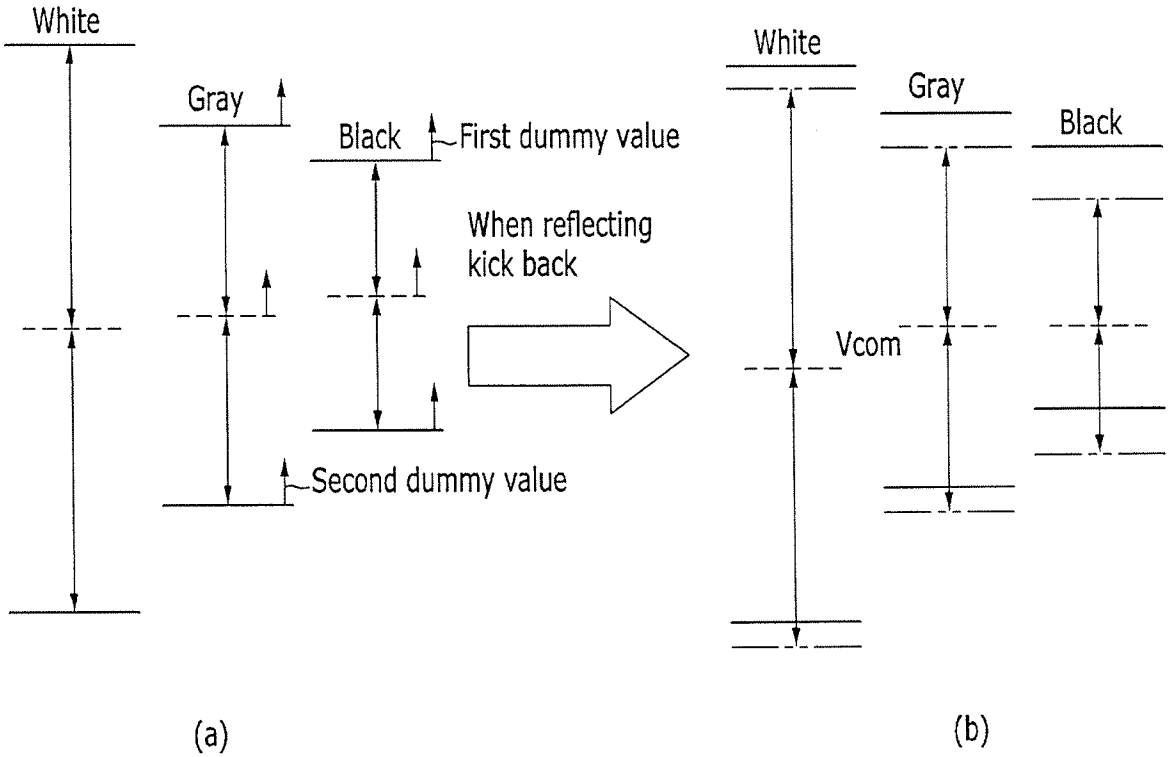
FIGS. 7(*a*)-(*b*) illustrate a process of optimizing a voltage applied to a pixel by asymmetrical gamma correction according to an exemplary embodiment of the present invention.

FIGS. 6(*a*)-(*b*) illustrate a process of optimizing a voltage applied to a pixel by asymmetrical gamma correction according to an exemplary embodiment of the present invention. FIGS. 7(*a*)-(*b*) illustrate a process of optimizing a voltage applied to a pixel by asymmetrical gamma correction according to an exemplary embodiment of the present invention.

In the present exemplary embodiment of FIGS. 6(*a*)-(*b*) and 7(*a*)-(*b*), a difference is whether an additional compensation and application is performed in the halftone gray.

Referring to FIG. 6(*a*), in the asymmetrical gamma correction method described in FIGS. 5(*a*)-(*b*), a first dummy value may be additionally compensatively applied to the offset value reflecting the kickback voltage Vkb in the black gray. Accordingly, the value compensatively applied in the black gray may become a first value obtained by adding the kickback voltage Vkb of the black gray and the first dummy value. Actually, the voltage applied to the pixel to which the kickback voltage Vkb is reflected is represented like FIG. 6(*b*). Accordingly, the offset value of the black gray applied to the pixel may be larger than the optimized common voltage Vcom, and the DC voltage may be accumulated in the black gray. It is effective to prevent the AC afterimage between the black gray and the white gray by the DC voltage of the accumulated black gray. However, it is vulnerable to prevent the AC afterimage of the halftone gray. In the present exemplary embodiment, the first dummy value may have a range of −20 mV to −100 mV or 20 mV to 100 mV. Further in an exemplary embodiment as described in connection with FIGS. 7(*a*)-(*b*), the first dummy value and the second dummy value may have a range of −20 mV to −100 mV or 20 mV to 100 mV, and the first dummy value and the second dummy value are not necessarily the same.

Referring to FIG. 7(*a*), in the asymmetrical gamma correction method described in FIGS. 5(*a*)-(*b*), a first dummy value may be additionally compensatively applied to the offset value reflecting the kickback voltage Vkb in the black gray, and a second dummy value may be additionally compensatively applied to the offset value reflecting the kickback voltage Vkb in the halftone gray. Accordingly, the value compensatively applied in the black gray becomes a first value obtained by adding the kickback voltage Vkb of the black gray and the first dummy value, and the value compensatively applied in the halftone gray may become a second value obtained by adding the kickback voltage Vkb of the halftone gray and the second dummy value. The kickback voltage Vkb of the white gray becomes a third value, and the third value is the same as the offset value to which only the kickback voltage Vkb is reflected. The first value and the second value are larger than the kickback voltage Vkb.

Actually, the voltage applied to the pixel to which the kickback voltage Vkb is reflected is represented like FIG. 7(*b*). Accordingly, the offset value of the black gray applied to the pixel and the offset value of the halftone gray may be larger than the optimized common voltage Vcom, and the DC voltage may be accumulated in not only the black gray but also the halftone gray. It is possible to prevent the AC afterimage between the halftone gray and the white gray by the accumulated DC voltage of the black gray and the halftone gray.

In the present exemplary embodiment, the optimized common voltage Vcom may be determined based on the offset value of the halftone gray. Accordingly, like FIG. 7(*b*), the offset value of the halftone gray is set as a preliminary common voltage so that the offset value of the white gray finally becomes the common voltage, and the common voltage may be optimized in the offset value of the white gray by shifting the preliminary common voltage. Therefore, the DC voltage may not be accumulated in the white gray.

The driving condition according to the present exemplary embodiment of the present invention is optimized in a device using a photo-alignment layer in a plane to line switching (PLS) mode like the liquid crystal display described in FIGS. 3 and 4. However, a driving condition according to exemplary embodiments of the present invention is not limited to the PLS mode, but may be applied to a horizontal field mode such as, for example, an in-plane switching (IPS) mode.

Hereinafter, a result of evaluating an afterimage in a liquid crystal display according to an exemplary embodiment of the present invention will be described with reference to FIGS. 8 and 9.

Figure 8:
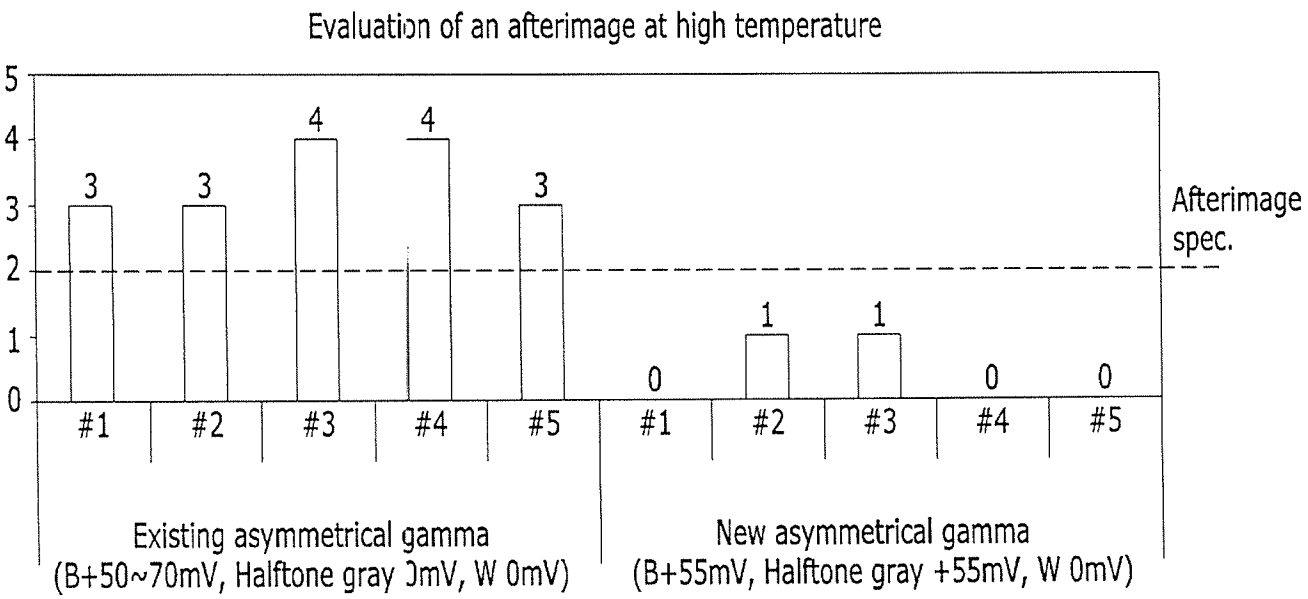
FIG. 8 is a graph illustrating an evaluation of an afterimage at a room temperature in a liquid crystal display according to an exemplary embodiment of the present invention in comparison with a related art.
Figure 9:
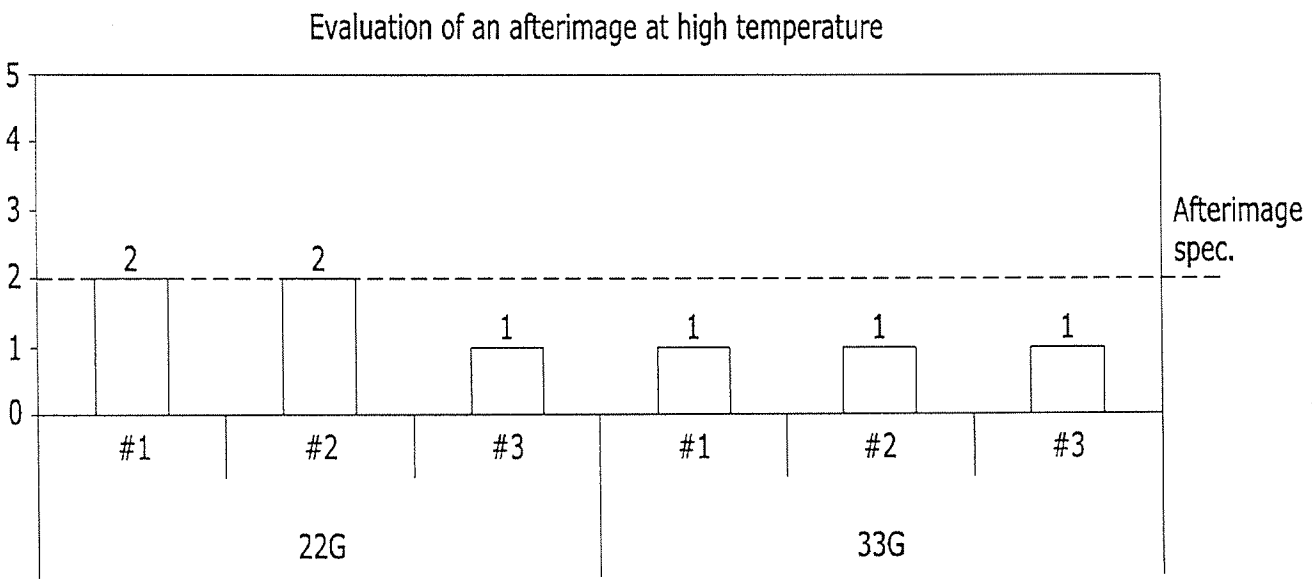
FIG. 9 is a graph illustrating an evaluation result of an afterimage at a high temperature in a liquid crystal display according to an exemplary embodiment of the present invention.

FIG. 8 is a graph illustrating an evaluation of an afterimage at room temperature in a liquid crystal display according to an exemplary embodiment of the present invention in comparison with a related art. FIG. 9 is a graph illustrating an evaluation result of an afterimage at a high temperature in a liquid crystal display according to an exemplary embodiment of the present invention. Herein, for an afterimage test, the liquid crystal display has a plane to line switching (PLS) mode and uses a photo-alignment layer, like the liquid crystal display described in FIGS. 3 and 4.

Referring to FIG. 8, an existing asymmetrical gamma is to compensatively apply the kickback voltage by setting the first dummy value of the black gray to 50 mV to 70 m, and a new asymmetrical gamma is to compensatively apply the kickback voltage by setting the first dummy value of the black gray to 55 mV, and the second dummy value of the halftone gray to 55 mV. By the new asymmetrical gamma correction, the result is shown as a visual level 2 or less which is an afterimage spec, and as a result, it can be seen that the afterimage difficulty is prevented at room temperature. Referring to FIG. 9, from the result that the halftone gray is evaluated to 22 gray and 33 gray, even in an evaluation of an afterimage at a high temperature of 60 degrees C., the result is shown as a visual level 2 or less which is an afterimage spec, and as a result, it can be seen that the afterimage difficulty is significantly prevented. Having described exemplary embodiments of the present invention, it is further noted that it is readily apparent to those of ordinary skill in the art that various modifications may be made without departing from the spirit and scope of the invention which is defined by the metes and bounds of the appended claims.

What is claimed is:

1. A liquid crystal display, comprising:

a signal controller configured to receive an input image signal corresponding to a gray from the outside;

an image signal corrector configured to correct the input image signal to generate a data input signal; and a data driver configured to supply a data voltage corresponding to the gray based on the data input signal, wherein the gray includes a black gray, a white gray, and a halftone gray between the black gray and the white gray, wherein the image signal corrector is configured to shift a first input image signal value corresponding to the black gray by a first value based on a common voltage, the image signal corrector is configured to shift a second input image signal value corresponding to the halftone gray by a second value based on the common voltage, and the image signal corrector is configured to shift a third input image signal value corresponding to the white gray by a third value based on the common voltage, wherein the first value is larger than a kickback voltage of the black gray, the second value is larger than a kickback voltage of the halftone gray, and the third value is equal to a kickback voltage of the white gray, wherein the kickback voltage of the black gray is larger than the kickback voltage of the halftone gray, and the kickback voltage of the halftone gray is larger than the kickback voltage of the white gray, and wherein a difference between the first value and the kickback voltage of the black gray is used to set a first dummy value and a difference between the second value and the kickback voltage of the halftone gray is used to set a second dummy value, and wherein the first dummy value and the second dummy value are different from each other.

2. The liquid crystal display of claim 1, wherein:

the common voltage is determined by shifting a preliminary common voltage by the second value, and the preliminary common voltage corresponds to an offset value of the halftone gray.

3. The liquid crystal display of claim 2, further comprising:

a first substrate;

a thin film transistor disposed on the first substrate; and a first electrode connected to the thin film transistor, wherein when the data voltage is applied to the first electrode, offset values of the black gray and the halftone gray are different from the common voltage, and an offset value of the white gray is the same as the common voltage.

4. The liquid crystal display of claim 1, further comprising:

a first substrate;

a thin film transistor disposed on the first substrate;

a first electrode connected to the thin film transistor; and a first alignment layer disposed on the first electrode, wherein the first alignment layer includes a copolymer of at least one of cyclobutanedianhydride (CBDA) and a cyclobutanedianhydride (CBDA) derivative, and a diamine.

5. The liquid crystal display of claim 4, wherein:

the first alignment layer is formed by polymerizing at least one of cyclobutanedianhydride (CBDA) represented by the following Chemical Formula (A) and a cyclobutanedianhydride (CBDA) derivative represented by the following Chemical Formula (B), and a diamine:

Chemical Formula (A)

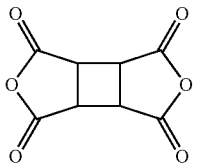

Chemical Formula (B)

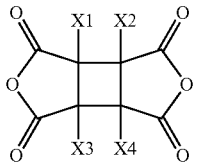

(wherein in Chemical Formula (B), each of X1, X2, X3, and X4 is hydrogen or an organic compound, and at least one of X1, X2, X3, and X4 is not hydrogen).

6. The liquid crystal display of claim 5, further comprising:

a second electrode disposed on the first substrate, wherein an insulating layer is disposed between the first electrode and the second electrode, the first electrode includes a plurality of branch electrodes, and the second electrode has a planar shape.

7. The liquid crystal display of claim 6, wherein:

the plurality of branch electrodes overlap with the second electrode having the planar shape.

8. The liquid crystal display of claim 7, further comprising:

a passivation layer disposed between the thin film transistor and the second electrode, wherein the thin film transistor and the first electrode are connected to each other through a contact hole passing through the passivation layer and the insulating layer.

9. A driving method of a liquid crystal display, the driving method comprising:

receiving an input image signal from the outside; and correcting the input image signal to generate a data input signal, wherein the correcting of the input image signal includes shifting a first input image signal value corresponding to a black gray by a first value based on a common voltage, shifting a second input image signal value corresponding to a halftone gray by a second value based on the common voltage, and shifting a third input image signal value corresponding to a white gray by a third value based on the common voltage, wherein the first value is larger than a kickback voltage of the black gray, the second value is larger than a kickback voltage of the halftone gray, and the third value is equal to a kickback voltage of the white gray, wherein the kickback voltage of the black gray is larger than the kickback voltage of the halftone gray, and the kickback voltage of the halftone gray is larger than the kickback voltage of the white gray, and wherein a difference between the first value and the kickback voltage of the black gray is used to set a first dummy value and a difference between the second value and the kickback voltage of the halftone gray is used to set a second dummy value, and wherein the first dummy value and the second dummy value are different from each other.

10. The driving method of claim 9, wherein:

the common voltage is determined by shifting a preliminary common voltage by the second value, and the preliminary common voltage corresponds to an offset value of the halftone gray.

11. The driving method of claim 10, wherein:

the liquid crystal display includes a first substrate, a thin film transistor disposed on the first substrate, and a first electrode connected to the thin film transistor, wherein when the data voltage is applied to the first electrode, offset values of the black gray and the halftone gray are different from the common voltage, and an offset value of the white gray is the same as the common voltage.

12. The driving method of claim 9, wherein:

the liquid crystal display includes a first substrate, a thin film transistor disposed on the first substrate, a first electrode connected to the thin film transistor, and a first alignment layer disposed on the first electrode, wherein the first alignment layer includes a copolymer of at least one of cyclobutanedianhydride (CBDA) and a cyclobutanedianhydride (CBDA) derivative, and a diamine.

13. The driving method of claim 12, wherein:

the first alignment layer is formed by polymerizing at least one of cyclobutanedianhydride (CBDA) represented by the following Chemical Formula (A) and a cyclobutanedianhydride (CBDA) derivative represented by the following Chemical Formula (B), and a diamine:

Chemical Formula (A)

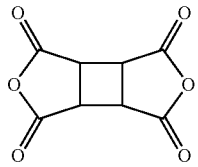

Chemical Formula (B)

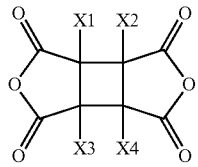

(wherein in Chemical Formula (B), each of X1, X2, X3, and X4 is hydrogen or an organic compound, and at least one of X1, X2, X3, and X4 is not hydrogen).

14. The driving method of claim 13, wherein:

the liquid crystal display further includes a second electrode disposed on the first substrate, and an insulating layer disposed between the first electrode and the second electrode, the first electrode includes a plurality of branch electrodes, and the second electrode has a planar shape.

15. The driving method of claim 14, wherein:

the plurality of branch electrodes overlap with the second electrode having the planar shape.

16. The driving method of claim 15, wherein:

the liquid crystal display further includes a passivation layer disposed between the thin film transistor and the second electrode, and the thin film transistor and the first electrode are connected to each other through a contact hole passing through the passivation layer and the insulating layer.

17. The driving method of claim 16, wherein the passivation layer includes a first passivation layer formed of an organic insulating material or an inorganic insulating material disposed on the thin film transistor, and a second passivation layer formed of an organic insulating material and stacked on the first passivation layer, wherein the first electrode is physically and electrically connected to the thin film transistor through the contact hole which passes through the first passivation layer, the second passivation layer and the insulating layer.

18. A liquid crystal display, comprising:

a plurality of gate lines extending substantially in a first direction and substantially parallel to each other;

a plurality of data lines substantially parallel to each other and extending in a second direction substantially perpendicular to the first direction;

a plurality of pixels including a switching element connected to the gate lines and data lines, a gray voltage generator configured to generate gray voltages related with transmittance of the pixels;

a gate driver connected to the gate lines and configured to apply gate signals to the gate lines by combining a gate-on voltage and a gate-off voltage;

a signal controller including an image signal corrector, wherein the signal controller is configured to receive a plurality of input image signals corresponding to a gray from the outside and an input control signal controlling display of the input image signals, wherein the gray includes a black gray, a white gray, and a halftone gray between the black gray and the white gray, wherein the image signal corrector of the signal controller is configured to correct the input image signals to generate correction image signals, and wherein the signal controller is configured to generate a gate control signal and a data control signal and to transmit the gate control signal to the gate driver and transmit the data control signal and the correction image signals to the data driver, wherein the image signal corrector is configured to correct the input image signals by shifting a first input image signal value corresponding to the black gray by a first value based on a common voltage, shifting a second input image signal value corresponding to the halftone gray by a second value based on the common voltage, and shifting a third input image signal value corresponding to the white gray by a third value based on the common voltage, wherein the first value is larger than a kickback voltage of the black gray, the second value is larger than a kickback voltage of the halftone gray, and the third value is equal to a kickback voltage of the white gray;

a data driver connected to the data lines and configured to receive the data control signal and the correction image signals from the signal controller and to select the gray voltages from the gray voltage generator corresponding to each of the correction image signals, and wherein the data driver is configured to convert the correction image signals into data voltages and apply the data voltages to the corresponding data lines, wherein the kickback voltage of the black gray is larger than the kickback voltage of the halftone gray, and the kickback voltage of the halftone gray is larger than the kickback voltage of the white gray, and wherein a difference between the first value and the kickback voltage of the black gray is used to set a first dummy value and a difference between the second value and the kickback voltage of the halftone gray is used to set a second dummy value, and wherein the first dummy value and the second dummy value are different from each other.

19. The liquid crystal display of claim 18, wherein the gate control signal includes a scanning start signal instructing scanning start, and at least one clock signal controlling an output period of the gate-on voltage and wherein the data control signal includes a horizontal synchronization start signal notifying transmission start of a digital image signal for pixels in one row, a load signal instructing the data voltage to be applied to the data lines, and a data clock signal.

20. The liquid crystal display of claim 19, wherein the gate control signal further includes an output enable signal configured to limit a duration time of the gate-on voltage, and wherein the data control signal further includes a reversion signal configured to reverse a polarity of the data voltage.

21. The liquid crystal display of claim 19, wherein the input control signal includes one of a vertical synchronization signal, a horizontal synchronization signal, a main clock signal, or a data enable signal.

* * * * *